US006066022A

United States Patent [19]

Fobean et al.

[11] Patent Number: 6,066,022

[45] Date of Patent: May 23, 2000

[54] COLLAPSIBLE ACTIVITY CENTER

[75] Inventors: Eric A. Fobean, Stow; Matthew R. Fuligni, Twinsburg; Paul Madan, University Hts., all of Ohio

[73] Assignee: The Little Tikes Company, Hudson, Ohio

[21] Appl. No.: 09/020,174

[22] Filed: Feb. 6, 1998

[51] Int. Cl.[7] ..... A63H 33/00

[52] U.S. Cl. ..... 446/227; 446/478; 446/487; 160/135

[58] Field of Search ..... 446/227, 478, 446/487; 160/135, 352, 353, 233; D21/336, 337, 489, 492, 494, 501, 502, 506–511, 811, 837; 16/334, 337, 350

[56] References Cited

U.S. PATENT DOCUMENTS

| | | | |
|---|---|---|---|
| D. 159,019 | 6/1950 | Valentine | 446/478 |
| D. 288,943 | 3/1987 | Kroll . | |
| D. 403,718 | 1/1999 | Fuligni | D21/475 |
| 984,735 | 2/1911 | Bailey . | |
| 1,022,137 | 4/1912 | Hodge | 160/135 |
| 1,228,536 | 6/1917 | Craig | 160/353 |
| 1,647,733 | 11/1927 | Keichline . | |
| 1,756,526 | 4/1930 | Thompson . | |
| 1,787,978 | 1/1931 | Gilmond | 446/478 |
| 3,108,398 | 10/1963 | Einfalt . | |
| 3,565,152 | 2/1971 | Cohn, Jr. et al. | 160/135 |
| 4,342,173 | 8/1982 | Otake . | |
| 4,536,162 | 8/1985 | Ace, Jr. et al. | 446/102 |
| 4,696,652 | 9/1987 | Reeder et al. | 446/75 |
| 4,764,142 | 8/1988 | Griffith et al. | 446/82 |
| 4,883,443 | 11/1989 | Chase | 446/478 |
| 5,319,905 | 6/1994 | Szirtes | 160/233 |
| 5,454,745 | 10/1995 | Spielberger | 446/227 |
| 5,544,870 | 8/1996 | Kelley et al. | 256/26 |

FOREIGN PATENT DOCUMENTS

| | | | |
|---|---|---|---|
| 357282 | 3/1990 | European Pat. Off. | 446/487 |
| 555188 | 8/1993 | European Pat. Off. | 446/487 |
| 2159425 | 12/1985 | United Kingdom | 446/487 |

OTHER PUBLICATIONS

Fisher–Price "Toyfair '95" advertisement, 3 pages (1995).

Playskool "Ages & Stages, Toy Fair 1994" advertisement, 3 pages (1994).

The Maya Group, Inc. "Tiny Love Soft Developmental Toys" advertisement, 1 page (1998).

*Primary Examiner*—Robert A. Hafer
*Assistant Examiner*—Jeffrey D. Carlson
*Attorney, Agent, or Firm*—Renner, Kenner, Greive, Bobak, Taylor & Weber

[57] ABSTRACT

A collapsible activity center (10) includes a frame (12) which has pivotally connected thereto a wall (14) and a wall (16). The frame (12) includes a support leg (24) connected to a hinge leg (26) by a cross-piece (28). The hinge leg (26) is provided with a pair of transversely extending ribs (54) that engage a rib (84) extending from each wall (14, 16) to allow pivotal movement of each. A latitudinal detent (94) is provided on the rib (84) to engage the hinge leg (26) to allow the walls (14, 16) to be selectively held in position with respect to the frame (12). The cross-piece (28) includes a handle opening (30) while the support leg (24) includes a lip (46) to assist in carrying the walls (14, 16) when they are closed and the frame (12) is lifted.

8 Claims, 5 Drawing Sheets

COLLAPSIBLE ACTIVITY CENTER

TECHNICAL FIELD

This invention relates to a child's toy that is collapsible from an open play position to a closed storage position. More particularly, this invention relates to a frame which carries two pivotable walls that are selectively held away from the frame when opened and carried by the frame when closed.

BACKGROUND ART

Several types of foldable play activity centers have been developed over the years. Typically these foldable activity centers include end-to-end walls or panels which fold out lengthwise to provide a front and a rear facade. These facades usually include attachments with indicia for the children to play with according to the appropriate theme. The walls of the play center are usually connected by a hinge mechanism so that the walls may fold upon themselves to facilitate storage.

One of these walls may be provided with a strap to assist in carrying the folded toy. As such, when one of the walls is lifted, the weight of the attached walls is directed through the hinges. This can result in the walls breaking away at the hinge of the wall that is lifted. Since the foldable walls tend to support one another when expanded, a broken panel likely renders the toy useless. Another drawback of known foldable play centers is that they provide very little, if any, lateral support and are easy to knock over when bumped.

Thus, the need exists for an economically manufactured toy which allows for added support of all the walls when carried and which allows the walls to be selectively held in position when in the open configuration.

DISCLOSURE OF THE INVENTION

It is thus an object of the present invention to provide a collapsible activity center for use as a child's toy.

It is another object of the present invention to provide an activity center, as above, in which a frame is provided with at least two walls pivotally extending from one end of the frame.

It is a further object of the present invention to provide an activity center, as above, in which the frame is provided with a cross-piece supported by a hinge leg and a support leg.

It is yet another object of the present invention to provide an activity center, as above, in which the hinge leg is provided with at least a pair of transversely extending ribs which pivotally receive mating ribs from each of the walls.

It is a further object of the present invention to provide an activity center, as above, in which the support leg includes an inwardly extending lip that carries the first and second walls when they are folded to their closed position.

It is an additional object of the present invention to provide an activity center, as above, in which the mating rib of each wall has a detent extending along the length thereof, wherein each detent engages the hinge leg to selectively hold the walls in position when the activity center is in an open position.

These and other objects of the present invention, as well as the advantages thereof over existing prior art forms, which will become apparent from the description to follow, are accomplished by the improvements hereinafter descried and claimed.

In general, a collapsible activity center made in accordance with the present invention includes a frame and two walls pivotally mounted to the frame. The frame has a hinge leg with at least one transversely extending rib member received by the walls.

In accordance with another aspect of the present invention, the frame has opposed facing surfaces and includes a cross-piece with opposed ends from which extends the hinge leg and a support leg to form an arch with an opening therethrough. The hinge leg includes a pair of transverse ribs extending from each opposed facing surface wherein each rib has opposed bearing surfaces with at least one of the bearing surfaces having a recess therein, and wherein the pair of transverse ribs form a notch therebetween. Each wall has a frame-face side facing a surface of the frame. Additionally, each wall has a hinge rib with opposed bearing surfaces, one of which has a protrusion that fits in the recess so that each wall is pivotable with respect to the hinge leg. Each hinge rib has a detent that selectively engages the hinge leg.

A preferred collapsible activity center incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
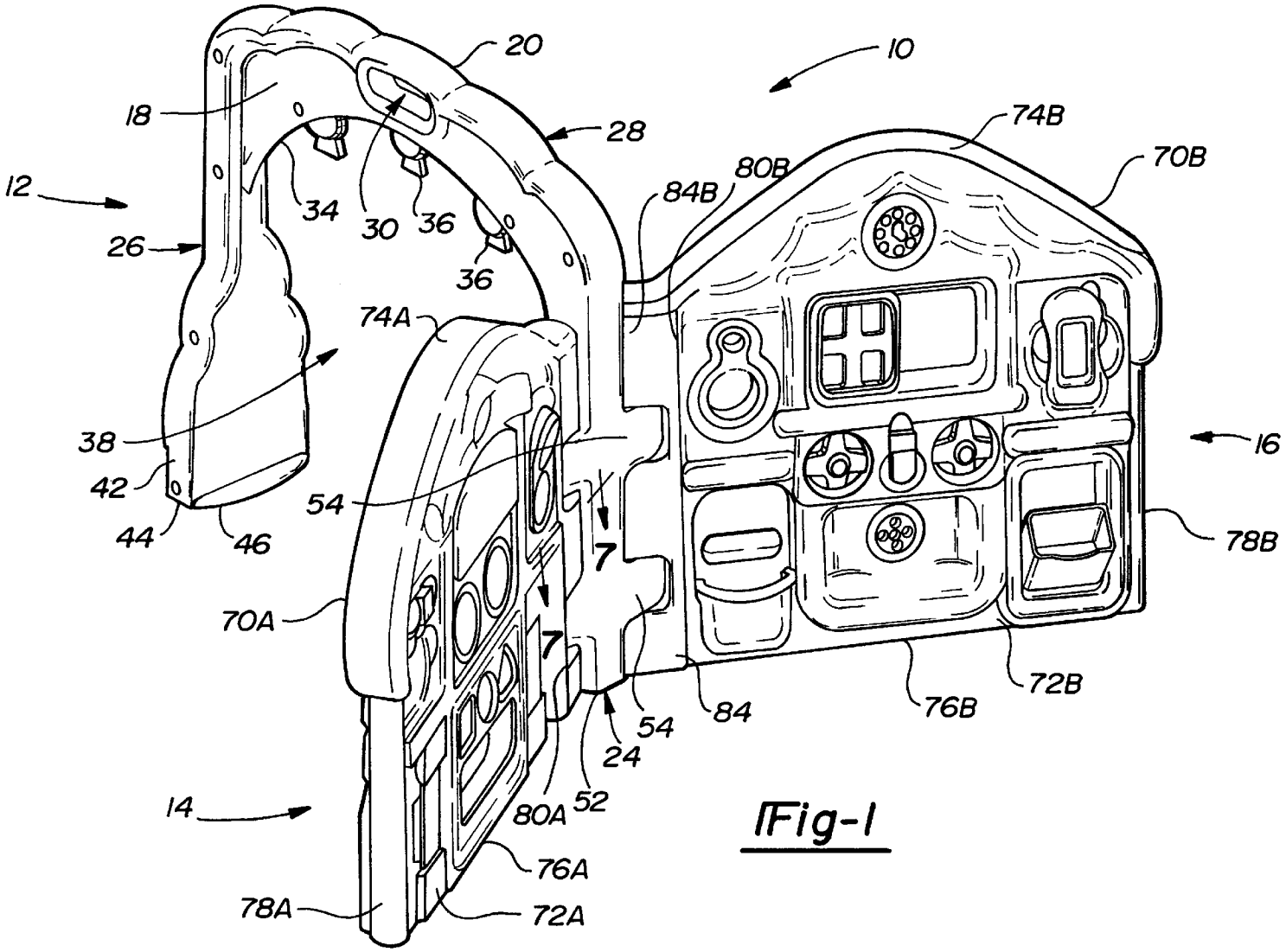
FIG. 1 is perspective view of a child's activity center shown in an open position.
Figure 2:
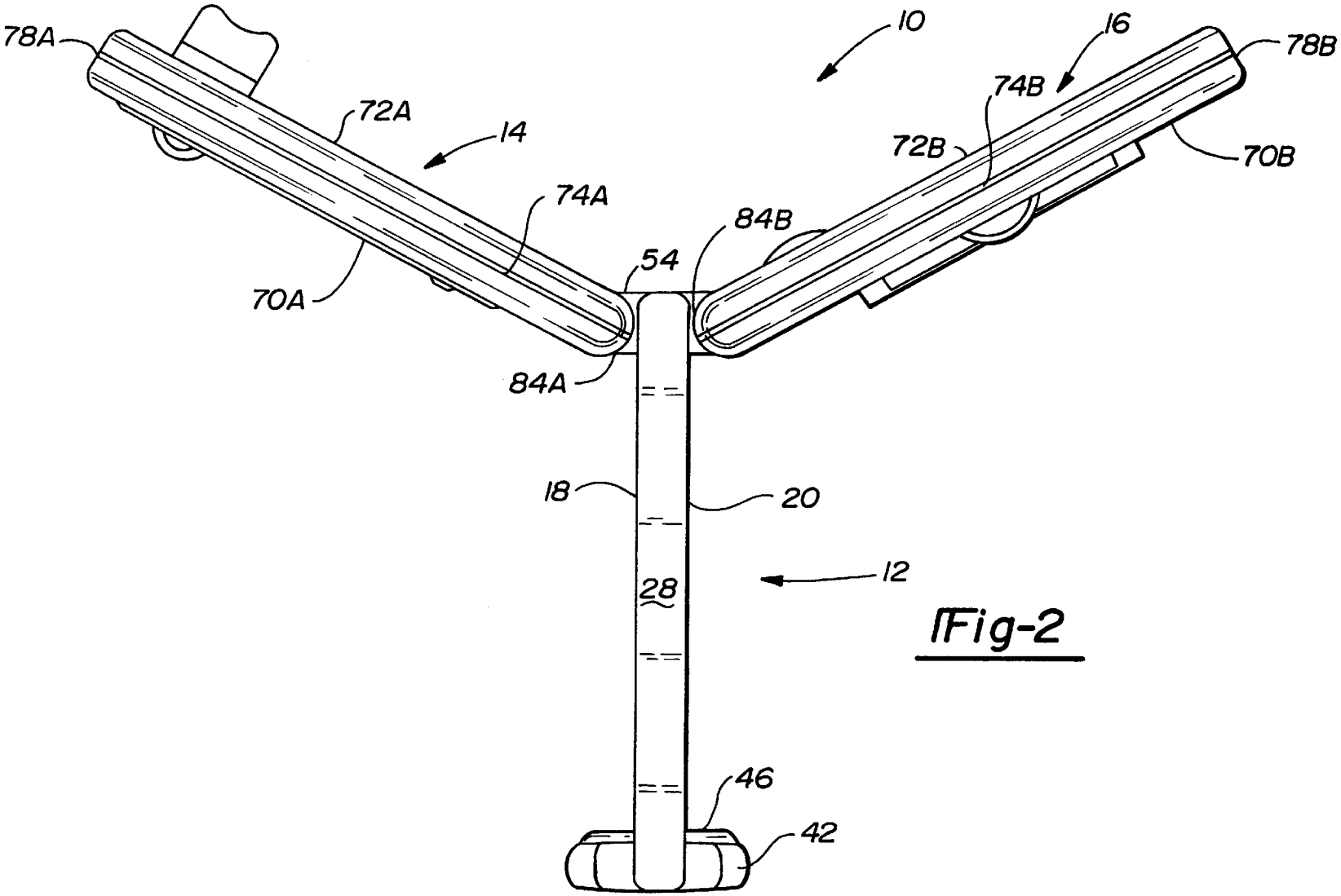
FIG. 2 is a top view showing the activity center in an open position.
Figure 3:
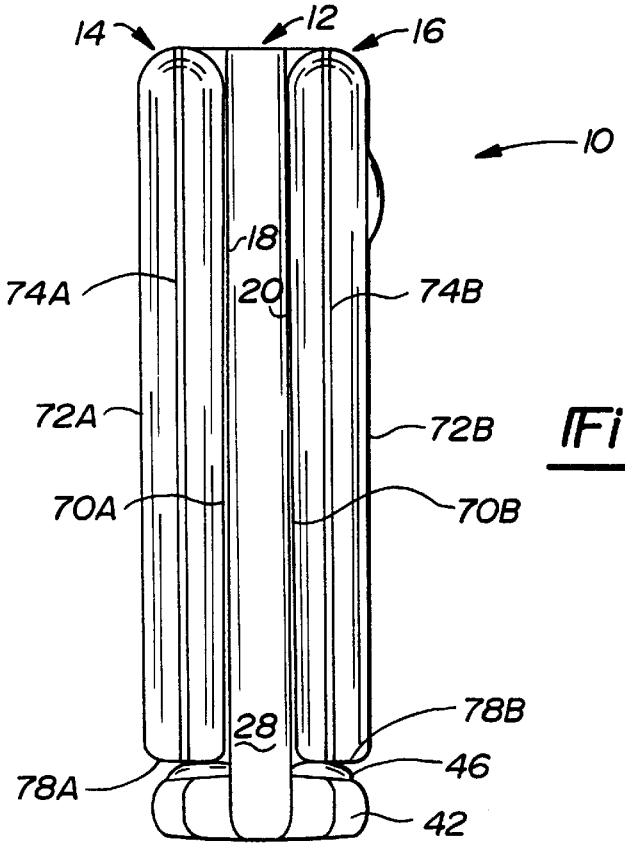
FIG. 3 is a top view of the activity center shown in a closed position.
Figure 4:
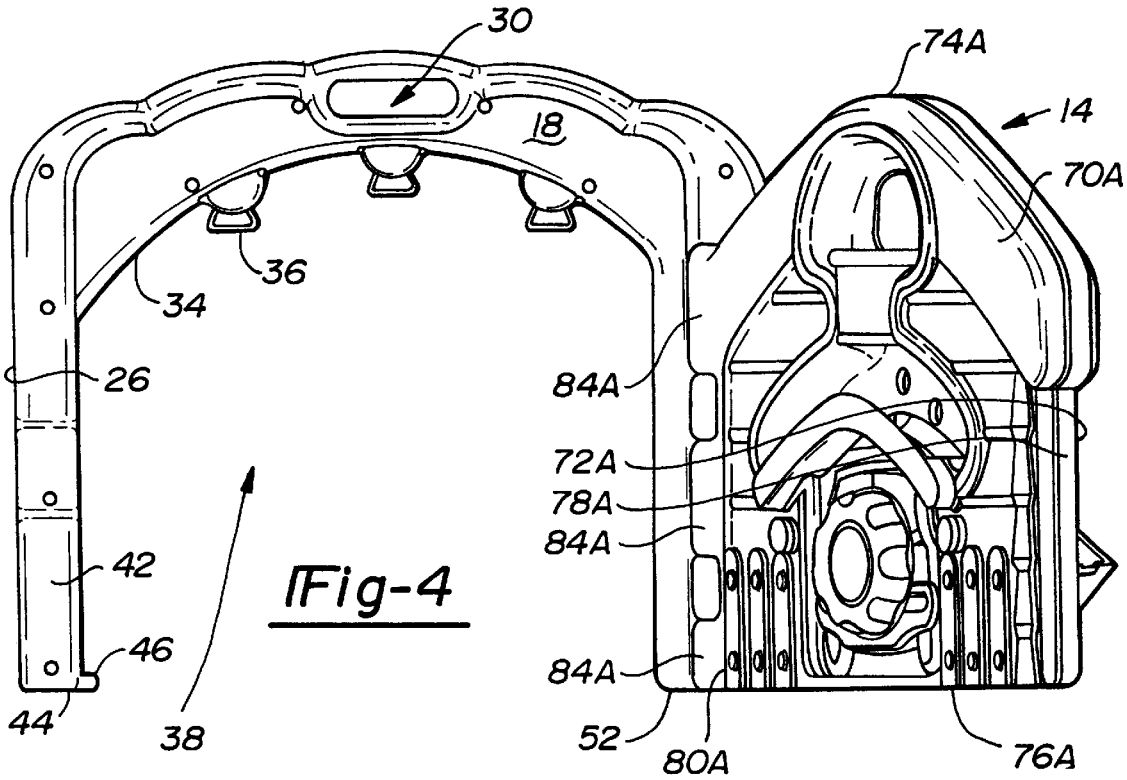
FIG. 4 is an elevational view of the activity center showing a frame and one of the two walls.

A collapsible activity center for use as a child's toy made in accordance with the concepts of the present invention is indicated generally by the numeral 10 in the accompanying drawings and is best seen generally in FIG. 1. The primary components of activity center 10 include an arch-shaped frame, generally indicated by the numeral 12, which has pivotally connected thereto a first wall, generally indicated by the numeral 14, and a second wall, generally indicated by the numeral 16. FIGS. 1 and 2 show activity center 10 in an open tripod position which allows children to play at or near any one of the three sides formed by the tripod. When the children are no longer playing with activity center 10, each wall 14, 16 is moveable toward frame 12 so that activity center 10 can be stored in a closet, underneath a bed, or in an appropriate storage area. The primary components are easily manufactured from a thermoplastic material which provides long-life.

Frame 12 includes a first facing surface 18, which faces first wall 14, and a second facing surface 20, which faces second wall 16. It will be appreciated that facing surfaces 18, 20 are substantially parallel to facing walls 14, 16, respectively, when they are in a closed position for storage.

When activity center 10 is in an open position, walls 14, 16 can be generally positioned 120° from one another and frame 12. Of course, walls 14, 16 could be positioned at different angles as deemed appropriate. Frame 12 includes a hinge leg, generally indicated by the numeral 24, and a support leg, generally indicated by the numeral 26. The top ends of hinge leg 24 and support leg 26 are connected to one another by a cross-piece 28. Walls 14 and 16 are pivotally connected to hinge leg 24.

Cross-piece 28 may include a handle opening 30 at about a mid-point thereof for easy grasping of frame 12 when moving activity center 10 to a desired location. Extending downwardly from cross-piece 28 is a recessed support flange 34 which provides stability to frame 12. Support flange 34 extends along the entire inner edge of hinge leg 24. A plurality of toy attachment members 36 may extend down from support flange 34. Toy attachment members 36 are provided with a release feature to allow their disengagement from support flange 34 if pulled excessively, without pulling activity center 10 over. Hinge leg 24, support leg 26, and cross-piece 28 form an opening 38 through which a child may crawl or walk depending upon the size of frame 12.

Support leg 26 includes an outwardly tapered base 42 at the end opposite cross-piece 28. Base 42 extends in a direction substantially perpendicular to cross-piece 28 and provides stability to activity center 10 whether it is closed or open. In other words, base 42 provides structural support to frame 12 so that it is not easily knocked down when bumped into. Support leg 26 has a bottom surface 44 from which an inwardly extending lip 46 protrudes toward hinge leg 24. In addition to providing further stability to frame 12, lip 46 supports and carries walls 14, 16 when they are in a closed position. It will be further appreciated that lip 46 exerts a lifting force on the bottom edges of walls 14, 16 when frame 12 is lifted by handle opening 30.

Figure 5:
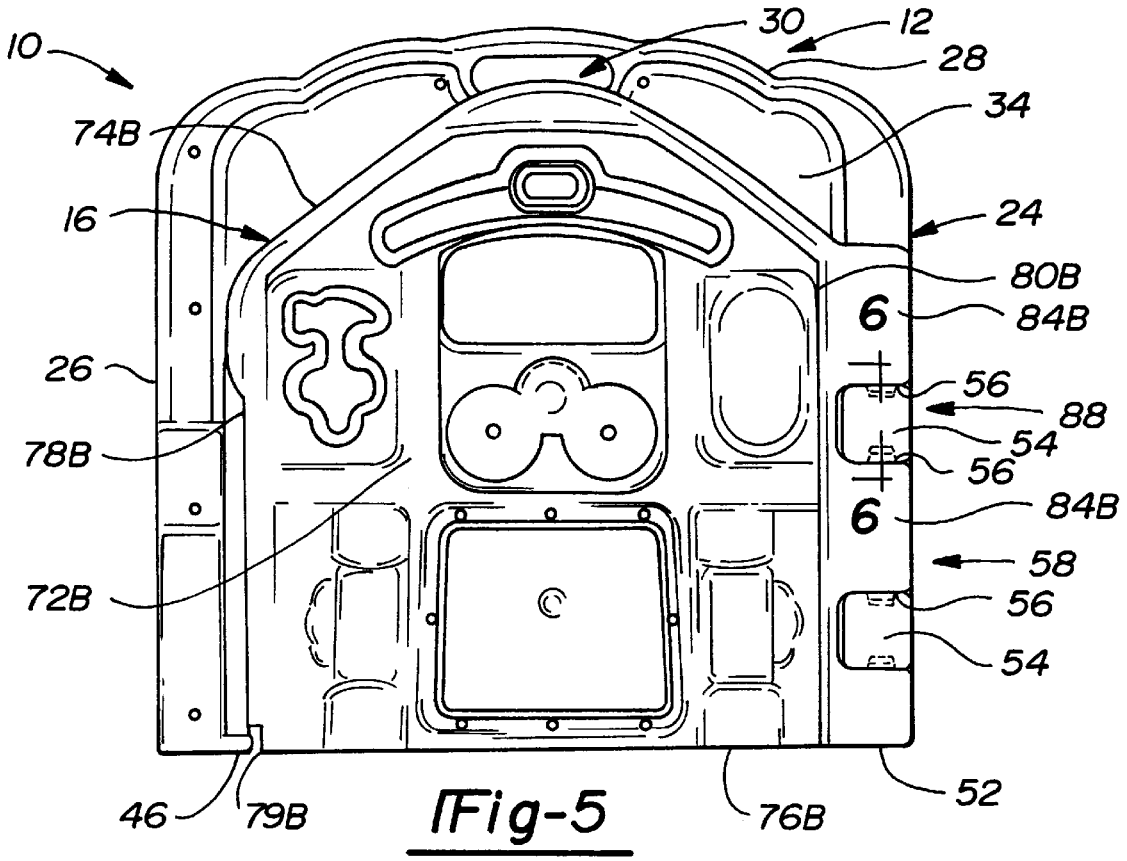
FIG. 5 is an elevational view of the activity center in a closed position.
Figure 6:
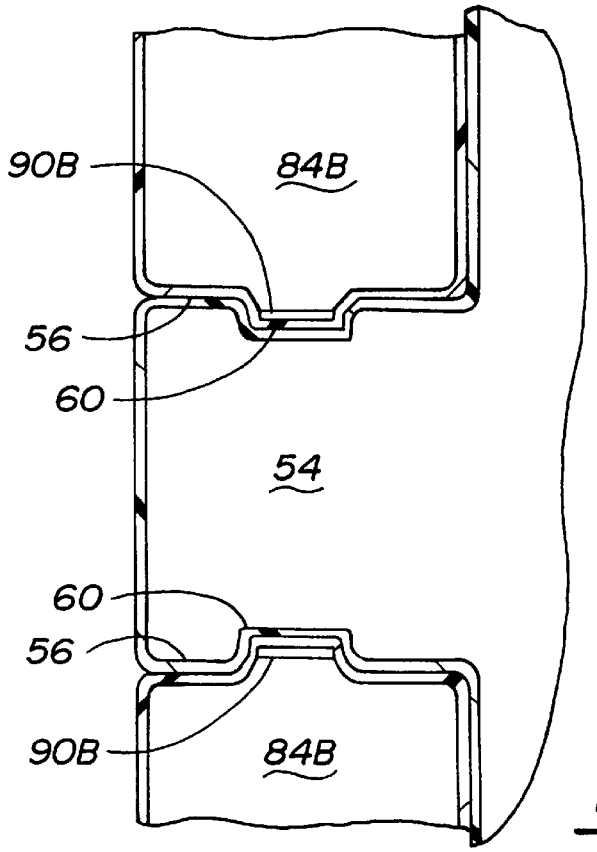
FIG. 6 is a fragmented cross-sectional view of the mating ribs taken along lines 6—6 of FIG. 5.
Figure 7:
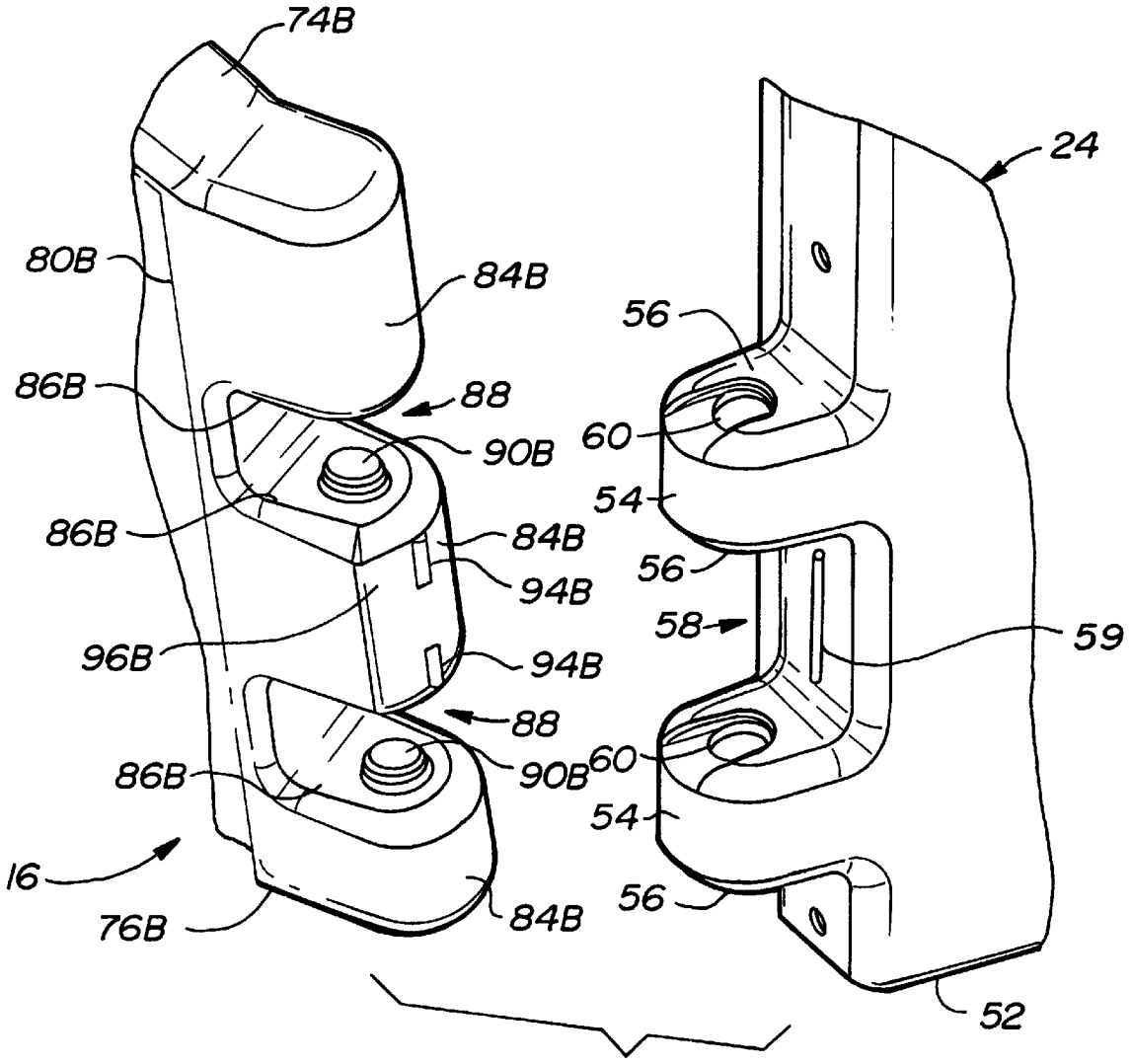
FIG. 7 is a fragmented exploded view of the mating ribs.

Hinge leg 24 includes a bottom 52 that is opposite cross-piece 28. Transversely extending from each facing surface 18, 20 and substantially perpendicular to hinge leg 24 are a pair of transversely extending ribs 54. Of course, any number of ribs may be provided as deemed appropriate. As best seen in FIGS. 5–7, each rib 54 includes opposed bearing surfaces 56 wherein a notch 58 is formed between bearing surfaces 56 that face one another. A latitudinal detent 59 extends from hinge leg 24 into notch 58 between opposed bearing surfaces 56. A recess 60 may extend into any one or all of the bearing surfaces 56 that is associated with each wall for reasons which will become apparent.

Each wall 14, 16 has a frame-face side 70*a*, 70*b* opposite an out-face side 72*a*, 72*b*, wherein the "a" suffix is associated with wall 14 and the "b" suffix is associated with wall 16. Sides 70, 72 are connected by a top edge 74*a*, 74*b* opposite a bottom edge 76*a*, 76*b*. Sides 70, 72 are also connected by a support edge 78*a*, 78*b* which is adjacent to or bears against an inner edge of support leg 26 when bottom edges 76*a*, 76*b* are placed adjacent lip 46. A notch 79*a*, 79*b* may be provided where the bottom edge 76*a*, 76*b* intersects support edge 78*a*, 78*b*. Notch 79*a*, 79*b* may nest on lip 46 when walls 14, 16 are in the closed position. Opposite support edge 78*a*, 78*b* is a hinge edge 80*a*, 80*b* which is mateably received upon transversely extending ribs 54. In particular, hinge edge 80*a*, 80*b* includes a plurality of extending ribs 84*a*, 84*b* each of which has opposed bearing surfaces 86*a*, 86*b*. Adjacent ribs 84*a*, 84*b* form notches 88 therebetween which are receivable upon transversely extending ribs 54. At least one of bearing surfaces 86*a*, 86*b* has a protrusion 90*a*, 90*b* which is receivable upon a respective recess 60. Accordingly, recess 60 and protrusion 90*a*, 90*b* allow walls 14, 16 to pivot with respect to frame 12. A pair of bumps 94*a*, 94*b* are provided at the end of extending ribs 84*a*, 84*b*. Each bump 94*a*, 94*b* engages latitudinal detent 59 and hinge leg 24. Accordingly, as walls 14, 16 are pivoted outwardly from frame 12, bumps 94*a*, 94*b* abut detent 59 between ribs 54 to selectively hold walls 14, 16 in their open position. Extending ribs 84*a*, 84*b* may be provided with a relatively flat surface 96*a*, 96*b* to positively engage hinge leg 24 between ribs 54.

Of course, recess 60 and protrusion 90 may be provided on opposite surfaces. In other words, a recess may extend into rib 84 and mate with a protrusion provided on rib 54. Likewise, bumps 94 may be provided on the hinge leg 24 and detent 59 may be provided on rib 84.

From the foregoing, it can be seen that walls 14, 16 are carried by frame 12 by virtue of the hinge connections provided by ribs 54 and 84 and inwardly extending lip 46. When activity center 10 is carried in a closed position, its weight is distributed between the hinge connection provided by rib members 54 and 84 and inwardly extending lip 46. When walls 14, 16 are moved away from frame 12 they are selectively held in position by bumps 94*a*, 94*b* engaging the hinge leg 24. In the selectively held open position, a tripod is formed by frame 12 and walls 14, 16 which provides stability to the entire structure so that it is not easily knocked over or moved out of position.

In view of the foregoing, it should thus be evident that a collapsible activity center for children to play with as described herein accomplishes the objects of the present invention and otherwise substantially improves the art.

What is claimed is:

1. A collapsible activity center comprising a frame, and a first wall and a second wall pivotable with respect to said frame, said frame having a hinge leg with at least one transversely extending rib member, said first and second walls pivotally receiving said at least one transversely extending rib member, wherein said frame includes a support leg connected to said hinge leg by a cross-piece and wherein said support leg has a lip extending toward said hinge leg, said lip supporting said first and second walls when said first and second walls are placed adjacent the frame.

2. A collapsible activity center according to claim 1 wherein said cross-piece has a handle opening.

3. A collapsible activity center according to claim 1 further comprising a recessed support flange extending from said cross-piece between said hinge leg and said support leg.

4. A collapsible activity center according to claim 1 wherein said rib member extends from both sides of said hinge leg and has opposed bearing surfaces, each said first and second wall having a hinge edge with at least one extending hinge rib mateable with at least one of said opposed bearing surfaces.

5. A collapsible activity center according to claim 4 wherein at least one of said opposed bearing surfaces has a recess and wherein said hinge rib has a protrusion for receiving said recess.

6. A collapsible activity center according to claim 5 wherein said hinge leg has two transversely extending rib members extending from both sides thereof forming a notch therebetween and a detent extending into said notch, each said first and second walls having a bump, such that said first and second walls are selectively held at an angular position with respect to said hinge leg when said detents engage said hinge leg and said bump.

7. A collapsible activity center comprising a frame having opposed facing surfaces, said frame having a cross-piece with opposed ends, a support leg extending from one end of said cross-piece and a hinge leg extending from the other end of said cross-piece, said cross-piece, said support leg and said hinge leg forming an opening, said hinge leg having a pair of transverse ribs extending from each opposed facing surface, each said rib having opposed bearing surfaces, at least one of said bearing surfaces having a recess, said pair of transverse ribs forming a notch therebetween, said hinge leg having a detent, a first wall and a second wall, each said wall having a frame face facing said opposed facing surfaces, each said wall having a hinge rib with a protrusion receivable in said recess, wherein each said wall is pivotable with respect to said hinge leg, each said hinge rib having a bump selectively mateable with said detent and a lip extending inwardly from said support leg for supporting said first and second walls when they are in a substantially parallel relationship with said facing surfaces.

8. A collapsible activity center according to claim 7 wherein said cross-piece has a handle opening.

* * * * *